US009933742B2

(12) United States Patent
Yamada

(10) Patent No.: US 9,933,742 B2
(45) Date of Patent: Apr. 3, 2018

(54) IMAGE FORMING APPARATUS AND IMAGE FORMING SYSTEM CONFIGURED TO CONTROL CONVEYANCE OF A SHEET TO PREVENT DEFORMATION DUE TO HEATING

(71) Applicant: Konica Minolta, Inc., Chiyoda-ku, Tokyo (JP)

(72) Inventor: Takashi Yamada, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/278,608

(22) Filed: Sep. 28, 2016

(65) Prior Publication Data

US 2017/0097595 A1 Apr. 6, 2017

(30) Foreign Application Priority Data

Oct. 1, 2015 (JP) ..... 2015-196002

(51) Int. Cl.
*G03G 15/20* (2006.01)
*G03G 15/00* (2006.01)

(52) U.S. Cl.
CPC ..... *G03G 15/6517* (2013.01); *G03G 15/2014* (2013.01); *G03G 15/657* (2013.01)

(58) Field of Classification Search
CPC ..... G03G 15/6517; G03G 15/657; G03G 15/2028
See application file for complete search history.

(56) References Cited

U.S. PATENT DOCUMENTS 5,774,777 A * 6/1998 Ohtsuka ..... B65H 23/0216 271/228
6,292,635 B1 * 9/2001 Tokairin ..... B41J 11/008 399/15
2002/0000457 A1 * 1/2002 Crowley ..... B41J 11/0005 226/31
2011/0123203 A1 * 5/2011 Kikuchi ..... G03G 15/238 399/21
2011/0176851 A1 * 7/2011 Kuwana ..... B41J 3/546 400/582

(Continued)

FOREIGN PATENT DOCUMENTS

JP 3570335 B2 9/2004

*Primary Examiner* — Sevan A Aydin
(74) *Attorney, Agent, or Firm* — Cantor Colburn LLP

(57) ABSTRACT

An image forming apparatus includes: a conveying portion configured to convey a continuous recording medium in a first conveying direction or in a second conveying direction opposite to the first conveying direction; an image forming portion configured to form a toner image on the continuous recording medium at a transfer nip; a fixing portion provided on a lower stream side of the image forming portion in the first conveying direction and configured to heat and fix the toner image formed on the continuous recording medium, at a fixing nip; a retaining portion provided between the transfer nip and the fixing nip in the first conveying direction and configured to retain a part of the continuous recording medium; and a control portion configured to control the conveying portion to convey a passed portion that has passed through the fixing nip and control the retaining portion to retain the passed portion.

8 Claims, 8 Drawing Sheets

(56) References Cited

U.S. PATENT DOCUMENTS

| | | | | |
|---|---|---|---|---|
| 2011/0211885 | A1* | 9/2011 | Kanazawa | B41J 3/60 399/395 |
| 2015/0309465 | A1* | 10/2015 | Matsumoto | G03G 15/70 399/21 |
| 2016/0342119 | A1* | 11/2016 | Fukai | G03G 15/6517 |
| 2017/0168443 | A1* | 6/2017 | Fukai | G03G 15/01 |

* cited by examiner

IMAGE FORMING APPARATUS AND IMAGE FORMING SYSTEM CONFIGURED TO CONTROL CONVEYANCE OF A SHEET TO PREVENT DEFORMATION DUE TO HEATING

CROSS REFERENCE TO RELATED APPLICATIONS

The entire disclosure of Japanese Patent Application No. 2015-196002 filed on Oct. 1, 2015 including description, claims, drawings, and abstract are incorporated herein by reference in its entirety.

BACKGROUND OF THE INVENTION

Field of the Invention

The present invention relates to an image forming apparatus and an image forming system.

Description of the Related Art

Typically, an image forming apparatus using an electrophotographic process technique (for example, printer, copying machine, or facsimile) irradiates (exposes) a charged photoreceptor with a laser beam based on image data so as to form an electrostatic latent image. A developing apparatus supplies toner to a photoreceptor drum including the electrostatic latent image formed thereon. Therefore, the electrostatic latent image is visualized and then a toner image is formed. Furthermore, after the toner image is directly or indirectly transferred to paper by a transfer nip, the toner image is heated and pressurized by a fixing nip formed of a pressure roller and a heating roller so as to be fixed. As a result, an image is formed on the paper. Generally, the image forming apparatus can also form an image on continuous paper, such as continuous-form rolled paper or fanfold paper (hereinafter, referred to as continuous paper), or a recording medium including tacky paper (sticky paper) with glue adhering between a print side and release paper, continuing with no space between the pieces of paper. Hereinafter, the recording medium, such as paper or tacky paper (sticky paper) continuing with no space between the pieces of paper, is referred to as a continuous recording medium.

In a case where the image forming apparatus forms an image on the continuous paper, the continuous paper is present without being interrupted over the entire apparatus. Thus, the continuous paper is still present at a position of the fixing nip with printing stopping. The continuous paper is heated at the fixing nip. Thus, when remaining present at the fixing nip, the continuous paper present at the fixing nip is heated at the position of the fixing nip so as to receive damage, such as deformation or degeneration. Therefore, the image forming apparatus is required to convey the continuous paper in a small amount in a paper conveying direction, for example, at a conveying speed of approximately 10 mm/sec during a period during which the temperature of a fixing device decreases to a degree of temperature at which the continuous paper is not damaged, during a stop of a print job.

The image forming apparatus is required to convey the continuous paper in a small amount in the paper conveying direction during a period during which the temperature of the fixing device increases to temperature suitable for fixing in order to start the print job. In this manner, the image forming apparatus conveys the continuous paper in the small amount in the paper conveying direction so as to prevent the continuous paper from being damaged due to the heating at the fixing nip.

The continuous paper conveyed in the small amount in the paper conveying direction is delivered with no image formed. Thus, the continuous paper becomes wasted paper (hereinafter, referred to as waste paper). In order to inhibit occurrence of the waste paper, for example, the following configuration is thought. The image forming apparatus conveys the continuous paper in a direction opposite to the paper conveying direction, to the upper stream side of the transfer nip in the paper conveying direction before the next print job starts. Then, in the next print job, the image is formed on the continuous paper conveyed in the opposite direction. With this configuration, in the next print job, the image is formed on the continuous paper conveyed in the opposite direction after the continuous paper is conveyed in the small amount in the paper conveying direction. Thus, the continuous paper conveyed in the small amount in the paper conveying direction can be reused.

JP 3570335 B2 discloses an image forming system that forms an image on continuous paper. In the image forming system described in JP 3570335 B2, a buffer is provided between an image forming apparatus and a post-processing apparatus disposed at a subsequent stage of the image forming apparatus. Specifically, after operation of the post-processing apparatus stops, the continuous paper is conveyed from a transferring portion to a fixing portion so that slack of the continuous paper is formed at the buffer. Before the next print job starts, the slack portion of the continuous paper formed at the buffer is conveyed in a direction opposite to a paper conveying direction, to the upper stream side of a transfer nip in the paper conveying direction. With this configuration, a defect of an image in the slack portion and a jam that are caused by continuously forming the slack of the continuous paper during execution of the print job can be inhibited. The continuous paper to which post-processing has been performed, can be prevented from being conveyed in the opposite direction.

However, when the continuous paper that has passed through the fixing nip, is conveyed to the upper stream side of the transfer nip in the paper conveying direction, heat of the continuous paper heated at the position of the fixing nip is transmitted to a transfer roller and a transfer belt included in the transfer nip so as to cause damage, such as deformation and degeneration. Thus, a problem that a toner image cannot be transferred to a desired position at the transfer nip occurs. The continuous paper is heated at the position of the fixing nip so as to be deformed. Thus, in a case where the toner image is transferred to the continuous paper deformed at the transfer nip, a problem that unevenness occurs in the toner image, occurs. In a case where the image is formed with respect to the continuous recording medium, such as tacky paper (sticky paper) with glue adhering between a print side and release paper, instead of the continuous paper, the glue extruded upon pressurization of the fixing nip adheres to the transfer belt. Thus, a problem that the glue that has adhered to the transfer belt adheres to a surface of the continuous recording medium occurs. Furthermore, a mechanism for conveying the continuous paper in the direction opposite to the paper conveying direction, to the upper stream side of the transfer nip in the paper conveying direction, is required to be provided to the transferring portion of the image forming apparatus. Thus, a problem that the image forming apparatus becomes complicated occurs.

SUMMARY OF THE INVENTION

An object of the present invention is to provide an image forming apparatus and an image forming system that are capable of solving a problem caused by conveying continuous paper that has passed through a fixing nip, to the upper stream side of a transfer nip in a paper conveying direction, the image forming apparatus and the image forming system each including a simple configuration.

To achieve the abovementioned object, according to an aspect, an image forming apparatus reflecting one aspect of the present invention comprises:

- a conveying portion configured to convey a continuous recording medium in a first conveying direction or in a second conveying direction opposite to the first conveying direction;
- an image forming portion configured to form a toner image on the continuous recording medium conveyed in the first conveying direction by the conveying portion, at a transfer nip;
- a fixing portion provided on a lower stream side of the image forming portion in the first conveying direction, the fixing portion configured to heat and fix the toner image formed on the continuous recording medium by the image forming portion, at a fixing nip;
- a retaining portion provided between the transfer nip and the fixing nip in the first conveying direction, the retaining portion configured to retain a part of the continuous recording medium; and
- a control portion configured to control the conveying portion to convey a passed portion that has passed through the fixing nip upon conveyance, out of the continuous recording medium in the second conveying direction, the control portion configured to control the retaining portion to retain the passed portion, after the conveyance of the continuous recording medium is performed in the first conveying direction in order to prevent the continuous recording medium from being deformed due to the heating of the fixing portion, in a case where the formation of the toner image by the image forming portion has been completed.

To achieve the abovementioned object, according to an aspect, an image forming system reflecting one aspect of the present invention comprises:

- a conveying portion configured to convey a continuous recording medium in a first conveying direction or in a second direction opposite to the first conveying direction;
- an image forming portion configured to form a toner image on the continuous recording medium conveyed in the first conveying direction by the conveying portion, at a transfer nip;
- a fixing portion provided on a lower stream side of the image forming portion in the first conveying direction, the fixing portion configured to heat and fix the toner image formed on the continuous recording medium by the image forming portion, at a fixing nip;
- a retaining portion provided between the transfer nip and the fixing nip in the first conveying direction, the retaining portion configured to retain a part of the continuous recording medium; and
- a control portion configured to control the conveying portion to convey a passed portion that has passed through the fixing nip upon conveyance, out of the continuous recording medium, in the second conveying direction, the control portion configured to control the retaining portion to retain the passed portion, after the conveyance of the continuous recording medium is performed in the first conveying direction in order to prevent the continuous recording medium from being deformed due to the heating of the fixing portion, in a case where the formation of the toner image by the image forming portion has been completed.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an embodiment of the present invention will be described in detail with reference to the drawings. However, the scope of the invention is not limited to the illustrated examples. Note that, according to the present embodiment, a configuration in which image formation is performed to continuous paper will be described. However, the present invention is not limited to this. According to an embodiment of the present invention, image formation may be performed to a continuous recording medium, such as tacky paper (sticky paper) or resin-made sheets like PET films, continuing with no space between the pieces of paper or between the sheets.

Figure 1:
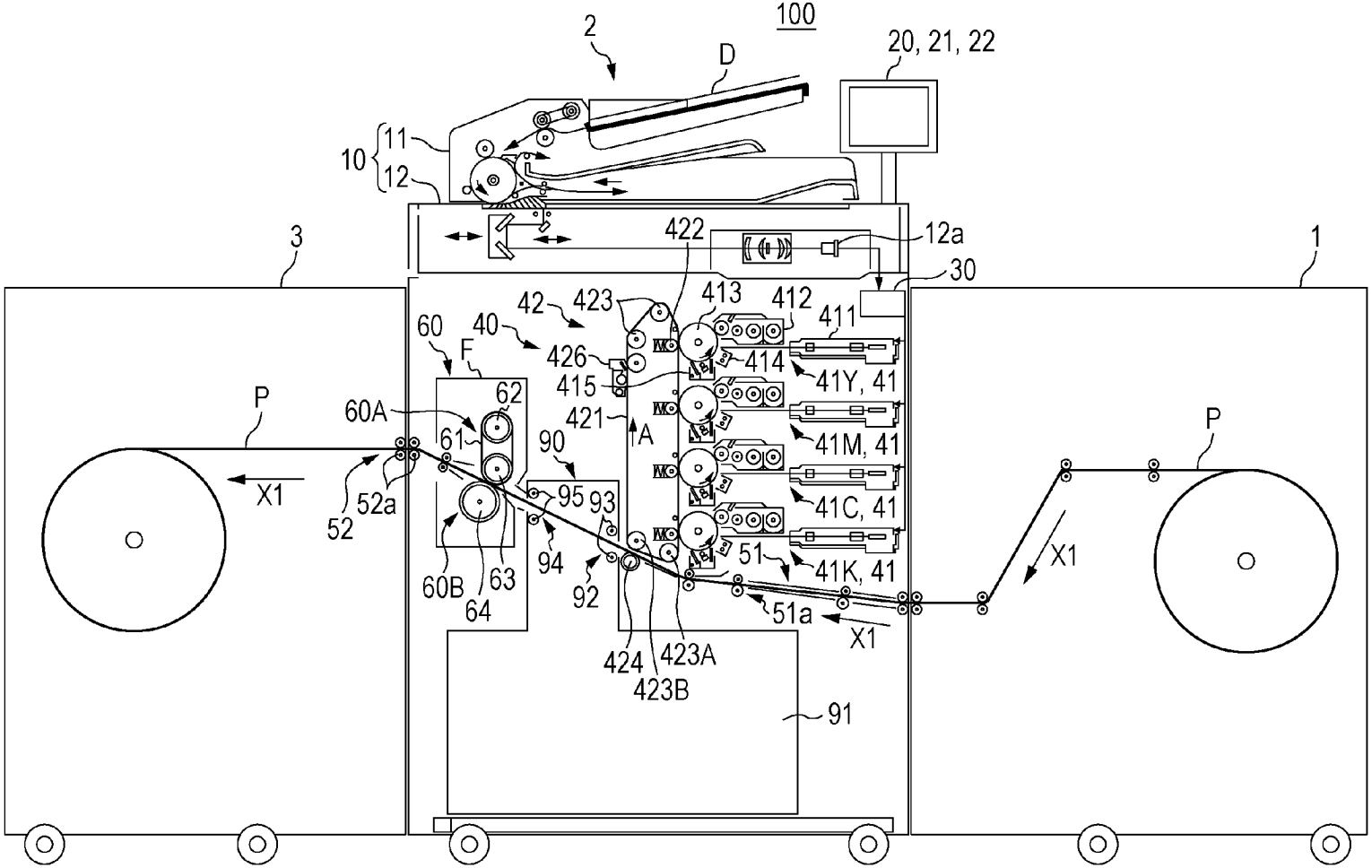
FIG. 1 is a schematic view of an image forming system according to an embodiment.
Figure 2:
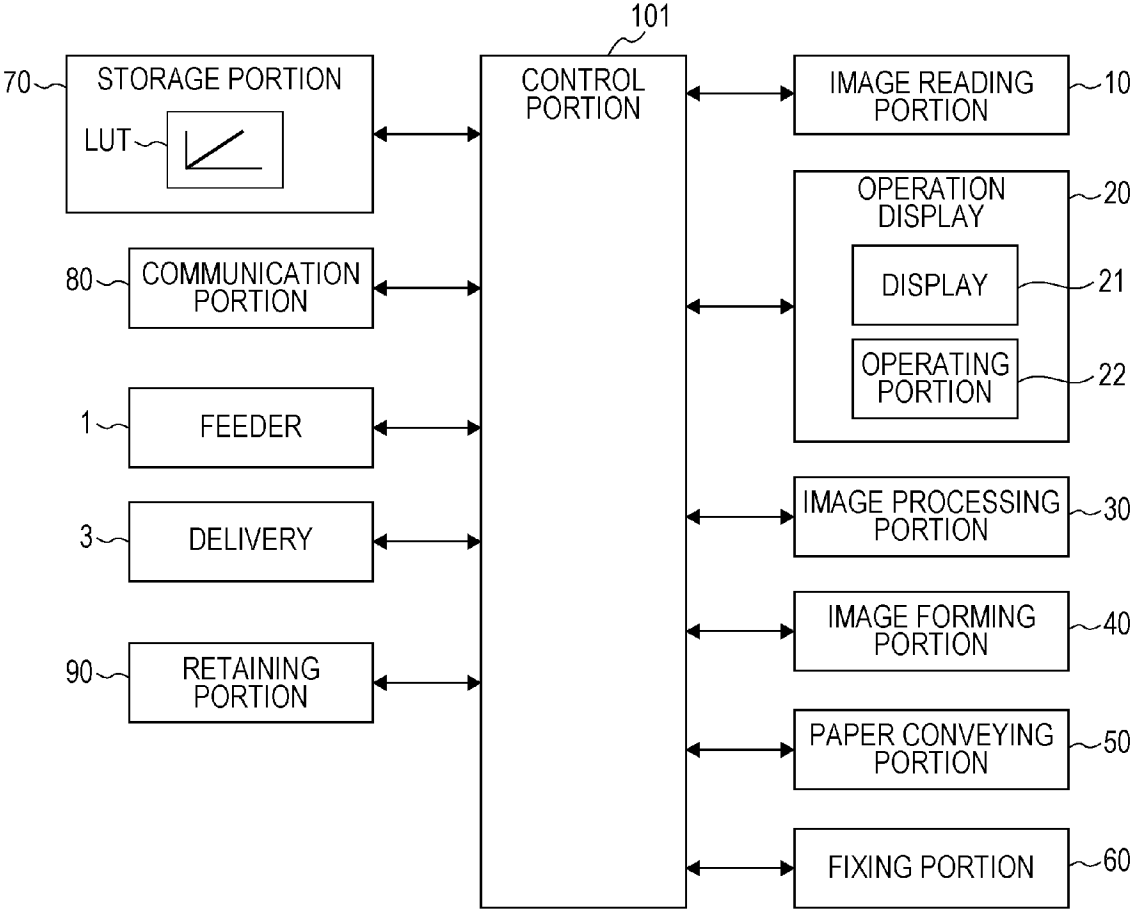
FIG. 2 is a diagram of main portions in a control system of an image forming apparatus included in the image forming system according to the present embodiment.

FIG. 1 is a schematic view of an entire configuration of an image forming system 100 according to the present embodiment. FIG. 2 is a diagram of main portions in a control system of an image forming apparatus 2 included in the image forming system 100 according to the present embodiment. The image forming system 100 uses continuous paper P indicated with a thick line in FIG. 1 as a recording medium, and forms an image on the continuous paper P. Here, the continuous paper P is, for example, paper having a length exceeding the width of a main body of the image forming apparatus 2 in a conveying direction.

As illustrated in FIG. 1, the image forming system 100 includes a feeder 1, the image forming apparatus 2, and a delivery 3 coupled to each other from the upper stream side in the conveying direction of the continuous paper P (hereinafter, also referred to as a paper conveying direction).

The feeder 1 is an apparatus that feeds the continuous paper P to the image forming apparatus 2. As illustrated in FIG. 1, the rolled continuous paper P is wound around a support shaft so as to be retained rotatably in a housing of the feeder 1. The feeder 1 feeds the continuous paper P wound around the support shaft to the image forming apparatus 2 at a constant speed through a plurality of pairs of conveying rollers (for example, delivering rollers and feeding rollers). Feeding operation of the feeder 1 is controlled by a control portion 101 included in the image forming apparatus 2.

Note that, the continuous paper P is not necessarily retained so as to be rolled in the feeder 1. A plurality of pieces of continuous paper P having a predetermined size (for example, 210 mm×1200 mm) may be retained.

The image forming apparatus 2 is an intermediate transfer color image forming apparatus using an electrophotographic process technique. That is, the image forming apparatus 2 primarily transfers different color toner images with Y (yellow), M (magenta), C (cyan), and K (black), formed on each photoreceptor drum 413, to an intermediate transfer belt 421. After superimposing the four color toner images on the intermediate transfer belt 421, the image forming apparatus 2 secondarily transfers the four color toner images to the continuous paper P fed from the feeder 1 so as to form the image.

The image forming apparatus 2 adopts the following tandem method. The photoreceptor drums 413 corresponding to the four colors including YMCK are disposed in series in a moving direction of the intermediate transfer belt 421. The different color toner images are successively transferred to the intermediate transfer belt 421 during one process.

As illustrated in FIG. 2, the image forming apparatus 2 includes, for example, an image reading portion 10, an operation display 20, an image processing portion 30, an image forming portion 40, a paper conveying portion 50, a fixing portion 60, and the control portion 101.

The control portion 101 includes, for example, a central processing unit (CPU), a read only memory (ROM), and a random access memory (RAM). The CPU reads a program corresponding to a processing content, from the ROM, and expands the program in the RAM. The CPU performs centralized control to operation of each block and the like in the image forming apparatus 2, in cooperation with the expanded program. In this case, various types of data stored in a storage portion 70 are referenced. The storage portion 70 includes, for example, a nonvolatile semiconductor memory (the so-called flash memory) and a hard disk drive.

The control portion 101 performs transmission and reception of the various types of data to an external apparatus (for example, personal computer) coupled to a communication network, such as a local area network (LAN) or a wide area network (WAN), through a communication portion 80 For example, the control portion 101 receives image data transmitted from the external apparatus, and forms the image on the continuous paper P based on the image data (input image data). The communication portion 80 includes a communication control card, such as a LAN card.

The image reading portion 10 includes, for example, an auto document feeder (referred to as ADF) 11 and a document image scanning apparatus (scanner) 12.

The auto document feeder 11 conveys documents D disposed on a document tray by using a conveying mechanism so as to deliver the documents D to the document image scanning apparatus 12. The auto document feeder 11 can successively read images of the large number of documents D (including both sides) disposed on the document tray, at once.

The document image scanning apparatus 12 optically scans each of the documents conveyed from the auto document feeder 11 onto contact glass or a document disposed on the contact glass. The document image scanning apparatus 12 images reflected light from each of the documents or the document, on a light receiving surface of a charge coupled device (CCD) sensor 12*a* so as to read a document image. The image reading portion 10 generates input image data based on a reading result from the document image scanning apparatus 12. The input image data is subjected to predetermined image processing in the image processing portion 30.

The operation display 20 includes, for example, a liquid crystal display (LCD) having a touch panel, and functions as a display 21 and an operating portion 22. The display 21 displays, for example, various types of operation screens, a state of an image, and an operation condition of each function in accordance with a display control signal input from the control portion 101. The operating portion 22 includes various operating keys, such as a numeric keypad and a start key. The operating portion 22 receives various types of input operation from a user and outputs an operating signal to the control portion 101.

The image processing portion 30 includes, for example, a circuit that performs digital image processing in response to an initial setting or a user setting, with respect to the input image data. For example, the image processing portion 30 performs gray level correction based on gray level correction data (gray level correction table) under the control of the control portion 101. In addition to the gray level correction, the image processing portion 30 performs various types of correction processing, such as color correction and shading correction, and compression processing with respect to the input image data. The image forming portion 40 is controlled based on the image data subjected to these types of processing.

The image forming portion 40 includes, for example, image forming units 41Y, 41M, 41C, and 41K for forming the image with different types of colored toner including a Y component, an M component, a C component, and a K component, based on the input image data, and an intermediate transfer unit 42.

The image forming units 41Y, 41M, 41C, and 41K for the Y component, the M component, the C component, and the K component, respectively, mutually have the same configuration. For convenience of illustrations and descriptions, shared constituent elements are denoted with the same reference signs. In a case where being distinguished, the constituent elements are denoted with the reference signs together with Y, M, C or K. In FIG. 1, reference signs are added to only constituent elements of the image forming unit 41Y for the Y component. For the other image forming units 41M, 41C, and 41K, reference signs are omitted.

Each of the image forming units 41 includes, for example, an aligner 411, a developing apparatus 412, one of the photoreceptor drums 413, a charging apparatus 414, and a drum cleaning apparatus 415.

The one of the photoreceptor drums 413 is, for example, a negatively charged organic photo-conductor (OPC) including an under coat layer (UCL), a charge generation layer (CGL), and a charge transport layer (CTL) sequentially disposed on a circumferential surface of an aluminum-made conductive cylindrical body (aluminum tube stock) having a drum diameter of 80 mm. The charge generation layer includes an organic semiconductor with a charge generation material (for example, phthalocyanine pigment) dispersed in a resin binder (for example, polycarbonate). The charge generation layer generates a pair of a positive charge and a negative charge due to exposure of the aligner 411. The charge transport layer includes a hole transport material (electron donating nitrogen-containing compound) dispersed in a resin binder (for example, polycarbonate resin). The charge transport layer transports the positive charge generated in the charge generation layer, to a surface of the charge transport layer.

The control portion 101 controls a driving current to be supplied to a driving motor (not illustrated) for rotating the photoreceptor drums 413 so as to rotate the photoreceptor drums 413 at a constant circumferential speed.

The charging apparatus 414 uniformly, negatively charges a surface of the one of the photoreceptor drums 413 having photoconductivity. The aligner 411 includes, for example, a semiconductor laser, and irradiates the one of the photoreceptor drums 413 with a laser beam corresponding to the image with an individual color component. The positive charge is generated in the charge generation layer of the one of the photoreceptor drums 413 so as to be transported to the surface of the charge transport layer. Thus, a surface charge (negative charge) of the one of the photoreceptor drums 413 is neutralized. An electrostatic latent image of the individual color component is formed on the surface of the one of the photoreceptor drums 413 due to a potential difference with respect to the circumference.

The developing apparatus 412 is a developing apparatus using two-component developing method. The developing apparatus 412 adheres the toner including the individual color component, to the surface of the one of the photoreceptor drums 413, and visualizes the electrostatic latent image so as to form the toner image.

The drum cleaning apparatus 415 includes, for example, a drum cleaning blade in sliding contact with the surface of the one of the photoreceptor drums 413, and removes transfer residual toner remaining on the surface of the one of the photoreceptor drums 413 after the primary transfer.

An intermediate transfer unit 42 includes, for example, the intermediate transfer belt 421, primary transfer rollers 422, a plurality of support rollers 423, a secondary transfer roller 424, and a belt cleaning apparatus 426.

The intermediate transfer belt 421 includes an endless belt, and is stretched over the plurality of support rollers 423 so as to have a loop. At least one of the plurality of support rollers 423 includes a driving roller, and the others each include a driven roller. For example, a roller 423A disposed on the lower stream side of the primary transfer roller 422 for the K component in a belt moving direction, is preferably a driving roller. Accordingly, the moving speed of the belt at a primary transfer portion easily remains constant. The driving roller 423A rotates so that the intermediate transfer belt 421 moves in a direction of arrow A at a constant speed.

The intermediate transfer belt 421 is a belt having conductivity and elasticity, and has a high-resistivity layer with a volume resistivity of from 8 to 11 log Ω·cm on a surface thereof. The intermediate transfer belt 421 is rotationally driven by a control signal from the control portion 101. Note that, quality of material, thickness, and hardness are not limited when the configuration of the intermediate transfer belt 421 has at least conductivity and elasticity.

The primary transfer rollers 422 are disposed on the side of an inner circumferential surface of the intermediate transfer belt 421, facing the photoreceptor drums 413 each having the individual color component. The primary transfer rollers 422 are pressed in contact with the photoreceptor drums 413 through the intermediate transfer belt 421. Thus, primary transfer nips for transferring toner images from the photoreceptor drums 413 to the intermediate transfer belt 421, are formed.

The secondary transfer roller 424 is disposed on the side of an outer circumferential surface of the intermediate transfer belt 421, facing a backup roller 423B disposed on the lower stream side of the driving roller 423A in the belt moving direction. The secondary transfer roller 424 is pressed in contact with the backup roller 423B through the intermediate transfer belt 421. Thus, a secondary transfer nip for transferring the toner images from the intermediate transfer belt 421 to the continuous paper P is formed.

When the intermediate transfer belt 421 passes through the primary transfer nips, the toner images on the photoreceptor drums 413 are sequentially superimposed on the intermediate transfer belt 421 so as to be primarily transferred. Specifically, primary transfer bias is applied to the primary transfer rollers 422. Charges having reversed polarity with respect to the toner are added to the side of aback surface of the intermediate transfer belt 421 (side on which the primary transfer rollers 422 abut). Thus, the toner images are electrostatically transferred to the intermediate transfer belt 421.

After that, when the continuous paper P passes through the secondary transfer nip, the toner images on the intermediate transfer belt 421 are secondarily transferred to the continuous paper P. Specifically, secondary transfer bias is applied to the secondary transfer roller 424. A charge having reversed polarity with respect to the toner is added to the side of a back surface of the continuous paper P (side on which the secondary transfer roller 424 abuts). Thus, the toner images are transferred electrostatically transferred to the continuous paper P. The continuous paper P including the toner images transferred thereto is conveyed to the fixing portion 60.

The belt cleaning apparatus 426 removes transfer residual toner remaining on the surface of the intermediate transfer belt 421 after the secondary transfer. Note that, instead of the secondary transfer roller 424, a configuration in which a secondary transfer belt is stretched over a plurality of support rollers including a secondary transfer roller so as to have a loop (so-called belt-type secondary transfer unit) may be adopted.

The fixing portion 60 includes, for example, an upper side fixing portion 60A and a lower side fixing portion 60B. The upper side fixing portion 60A has a fixing-surface-side member disposed on the side of a fixing surface of the continuous paper P (surface on which the toner images have been formed). The lower side fixing portion 60B has a back-surface-side support member disposed on the side of a back surface of the continuous paper P (surface opposite to the fixing surface). The back-surface-side support member is pressed in contact with the fixing-surface-side member. Thus, a fixing nip through which the continuous paper P is conveyed while being clamped is formed.

The fixing portion 60 heats and pressurizes the continuous paper P that includes the toner images secondarily transferred thereto and that has been conveyed, at the fixing nip. Thus, the toner images are fixed on the continuous paper P. The fixing portion 60 is disposed as a unit in a fixing device F. An air separation unit that separates the continuous paper P from the fixing-surface-side member or the back-surface-side support member by blowing air may be disposed in the fixing device F.

The upper side fixing portion 60A includes an endless fixing belt 61 being the fixing-surface-side member, a heating roller 62, and a fixing roller 63 (belt heating method). The fixing belt 61 is stretched over the heating roller 62 and the fixing roller 63 with predetermined belt tension (for example, 40 N).

The fixing belt 61 uses, for example, polyimide (PI) having a thickness of 80 μm as a substrate. An outer circumferential surface of the substrate is covered with heat-resistant silicon rubber (hardness: JIS-A30°) having a thickness of 250 μm as an elastic layer. Furthermore, an outer layer (release layer) is coated with perfluoro alkoxy alkane (PFA), being a heat-resistant resin, with a thickness of 70 μm. The outer diameter of the fixing belt 61 is, for example, 100 mm in size. The fixing belt 61 is in contact with the continuous paper P including the toner images formed thereon. The fixing belt 61 heats and fixes the toner images onto the continuous paper P at fixing temperature (for example, from 160 to 200° C.). Here, the fixing temperature is a temperature at which an amount of heat necessary for melting the toner on the continuous paper P can be supplied. The fixing temperature depends on, for example, the type of paper of the continuous paper P to which the image formation is performed.

The heating roller 62 includes a heating source (halogen heater) inside, and heats the fixing belt 61. The heating source heats the heating roller 62. As a result, the fixing belt 61 is heated. The temperature of the heating source is controlled by the control portion 101. Thus, the temperature of the fixing belt 61 becomes 180° C. being a setting temperature. The outer diameter of the heating roller 62 is, for example, 50 mm in size.

The fixing roller 63 includes a configuration in which an elastic layer including, for example, silicon rubber, (for example, thickness: 10 mm) and an outer layer including a fluororesin, such as PTFE, (for example, thickness: 70 μm) are disposed and formed in sequence on a circumferential surface of a columnar cored bar including, for example, aluminum. The outer diameter of the fixing roller 63 is, for example, 40 mm in size. Driving control of the fixing roller 63 (for example, rotation between on and off, and circumferential speed) is performed by the control portion 101.

The fixing portion 60 according to the present embodiment conveys the continuous paper P in the paper conveying direction or in a direction opposite to the paper conveying direction, by control of the control portion 101. In a case where the continuous paper P is conveyed in the paper conveying direction, the control portion 101 rotates the fixing roller 63 in a clockwise direction. The fixing roller 63 is rotated so that the fixing belt 61 and the heating roller 62 are driven so as to rotate in the clockwise direction. Meanwhile, in a case where the continuous paper P is conveyed in the direction opposite to the paper conveying direction, the control portion 101 rotates the fixing roller 63 in a counterclockwise direction. The fixing roller 63 is rotated so that the fixing belt 61 and the heating roller 62 are driven to rotate in the counterclockwise direction.

The lower side fixing portion 60B includes a pressure roller 64 being the back-surface-side support member (roller pressurizing method). The pressure roller 64 includes a configuration in which an elastic layer including, for example, silicon rubber, and an outer layer including a PFA tube are disposed and formed in sequence on an outer circumferential surface of a columnar cored bar including, for example, iron. The outer diameter of the pressure roller 64 is, for example, 40 mm in size. The pressure roller 64 is pressed in contact with the fixing roller 63 with a predetermined fixing load (for example, 1000 N) by a pressure contact/separation portion (not illustrated) through the fixing belt 61. The pressure contact/separation portion has a known configuration. The pressure contact/separation portion presses the fixing belt 61 and the pressure roller 64 in contact with each other, or separates the fixing belt 61 and the pressure roller 64 from each other. In this manner, the fixing nip through which the continuous paper P is conveyed while being clamped is formed between the fixing belt 61 and the pressure roller 64. Driving control of the pressure roller 64 (for example, rotation between on and off, and circumferential speed) and driving control of the pressure contact/separation portion are performed by the control portion 101.

In a case where the continuous paper P is conveyed in the paper conveying direction, the control portion 101 rotates the pressure roller 64 in the counterclockwise direction. Meanwhile, in a case where the continuous paper P is conveyed in the direction opposite to the paper conveying direction, the control portion 101 rotates the pressure roller 64 in the clockwise direction.

The paper conveying portion 50 includes, for example, a paper feed conveying portion 51 and a paper delivery conveying portion 52.

The paper feed conveying portion 51 conveys the continuous paper P conveyed from the feeder 1, to the image forming portion 40. The paper feed conveying portion 51 includes a plurality of pairs of conveying rollers including a pair of resist rollers 51*a*. A resist roller portion including the pair of resist rollers 51*a* disposed therein, corrects a tilt and a deviation of the continuous paper P.

The paper delivery conveying portion 52 conveys the continuous paper P conveyed from the fixing portion 60, to the delivery 3. The paper delivery conveying portion 52 includes a pair of conveying rollers (a pair of paper delivery rollers) 52*a*. The paper delivery conveying portion 52 according to the present embodiment includes the following configuration. The control portion 101 controls a rotating direction of the pair of conveying rollers 52*a* in the paper delivery conveying portion 52 so that the continuous paper P can be conveyed in the paper conveying direction or in the direction opposite to the paper conveying direction.

The continuous paper P fed from the feeder 1 to the image forming apparatus 2, is conveyed to the image forming portion 40 by the paper feed conveying portion 51. In the image forming portion 40, the toner images of the intermediate transfer belt 421 are collectively, secondarily transferred to one surface of the continuous paper P. Then, a fixing process is performed in the fixing portion 60. The continuous paper P including the image formation performed thereto, is conveyed to the delivery 3 by the paper delivery conveying portion 52 including the pair of conveying rollers (pair of paper delivery rollers) 52*a*.

The delivery 3 is an apparatus that winds and houses the continuous paper P conveyed from the image forming apparatus 2. As illustrated in FIG. 1, for example, the continuous paper P is wound around a support shaft and then is retained so as to be rolled in a housing of the delivery 3. Therefore, the delivery 3 winds the continuous paper P conveyed from the image forming apparatus 2, around the support shaft at a constant speed, through a plurality of pairs of conveying rollers (for example, delivering rollers and feeding rollers). Winding operation of the delivery 3 is controlled by the control portion 101 included in the image forming apparatus 2.

The delivery 3 conveys the wound continuous paper P in the direction opposite to the paper conveying direction so as to deliver the continuous paper P to the image forming apparatus 2. Conveying operation in the opposite direction in the delivery 3 is controlled by the control portion 101 included in the image forming apparatus 2.

A retaining portion 90 is disposed between the image forming portion 40 and the fixing portion 60. The retaining portion 90 is configured to retain part of the continuous paper P in a hollow portion 91 disposed across a space below the image forming apparatus 2 from a space between the image forming portion 40 and the fixing portion 60.

The retaining portion 90 includes an opening 92 on the side of the image forming portion 40 on a conveying path of the continuous paper P. A pair of conveying rollers 93 is disposed in proximity to the opening 92. The retaining portion 90 includes an opening 94 on the side of the fixing portion 60 on the conveying path of the continuous paper P. A pair of conveying rollers 95 is disposed in proximity to the opening 94.

The pairs of conveying rollers 93 and 95 are movable in a direction in which the continuous paper P is clamped (in an upper and lower direction in FIG. 1) by the control of the control portion 101. The pair of conveying rollers 93 clamps the continuous paper P by the control of the control portion 101. The pair of conveying rollers 95 rotates with the continuous paper P clamped, and conveys the continuous paper P in the paper conveying direction or in the direction opposite to the paper conveying direction, by the control of the control portion 101.

In a case where the image forming apparatus 2 forms the image on the continuous paper P, the continuous paper P is present without being interrupted over the entire apparatus. Thus, the continuous paper P is still present at a position of the fixing nip with the printing stopping. The continuous paper P is heated at the fixing nip. Thus, when remaining present at the position of the fixing nip, the continuous paper P present at the position of the fixing nip is heated at the fixing nip so as to receive damage, such as deformation or degeneration.

In order to prevent the damage, such as deformation or degeneration of the continuous paper P due to the heating at the position of the fixing nip, the control portion 101 performs processing for conveying the continuous paper P in a small amount in the paper conveying direction during a period during which the temperature in the fixing device F decreases to a degree of temperature at which the continuous paper P is not damaged, during a stop of the print job (hereinafter, referred to as fixing-device temperature-decrease processing). When the print job starts, the control portion 101 performs processing for conveying the continuous paper P in a small amount in the paper conveying direction during a warm-up during which the temperature in the fixing device F increases to the fixing temperature (hereinafter, referred to as warm-up processing). Here, the degree of temperature at which the continuous paper P is not damaged, is referred to as stop feasible temperature. Note that the stop feasible temperature depends on, for example, the type of paper of the continuous paper P, and is, for example, approximately 100° C.

The continuous paper P conveyed in the small amount in the paper conveying direction, is delivered with no image formed. Thus, the continuous paper P becomes waste paper. In order to inhibit occurrence of the waste paper, for example, the following configuration is thought. The image forming apparatus 2 conveys the continuous paper P in the direction opposite to the paper conveying direction, to the upper stream side of the transfer nip in the paper conveying direction before the next print job starts. Then, in the next print job, the image is formed on the continuous paper P conveyed in the opposite direction. However, with this configuration, the continuous paper P that has passed through the fixing nip is conveyed to the upper stream side of the transfer nip in the paper conveying direction. Thus, heat of the continuous paper P heated at the position of the fixing nip, damages the transfer nip.

In order to solve the problem caused by conveying the continuous paper P that has passed through the fixing nip, to the upper stream side of the transfer nip in the paper conveying direction, with a simple configuration, the image forming system 100 according to the present embodiment performs processing for conveying the continuous paper P conveyed in the small amount in the paper conveying direction, in the direction opposite to the paper conveying direction and for retaining the continuous paper P in the retaining portion 90 during the fixing-device temperature-decrease processing between the fixing-device temperature-decrease processing and the warm-up processing, by the control of the control portion 101 (hereinafter, referred to as rewind processing).

Figure 3:
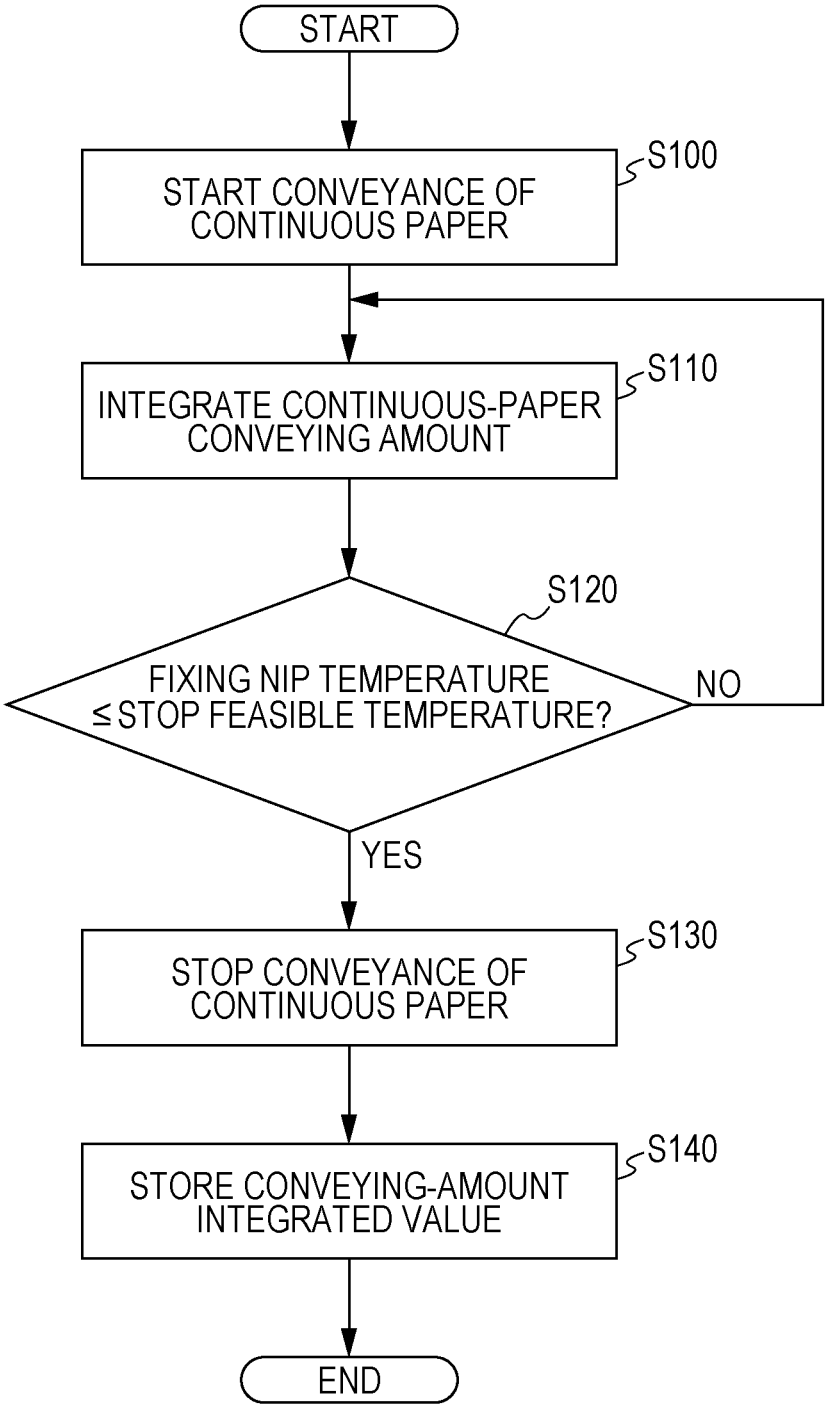
FIG. 3 is a flow chart of conveying-amount integration processing according to the present embodiment.

First, the fixing-device temperature-decrease processing will be described. During the fixing-device temperature-decrease processing according to the present embodiment, continuous-paper conveying-amount integration processing for integrating a continuous-paper conveying amount that indicates an amount of the continuous paper P conveyed in the paper conveying direction, is performed during a period between a point in time at which conveying control starts and a point in time at which the temperature in the fixing device F decreases to the stop feasible temperature. The continuous-paper conveying-amount integration processing in the image forming system 100 will be specifically described with reference to FIG. 3.

The control portion 101 controls the fixing portion 60 so that the heating of the heating roller 62 stops, in order to decrease the temperature in the fixing device F in a case where the print job stops or is completed. The control portion 101 controls the feeder 1, the image forming portion 40, the paper conveying portion 50, the fixing portion 60, and the delivery 3 so as to start the conveying control for conveying the continuous paper P in the paper conveying direction (S100).

Next, the control portion 101 integrates the continuous-paper conveying amount that indicates the amount of the continuous paper P conveyed in the paper conveying direction, during the period between the point in time at which the conveying control starts and the point in time at which the temperature in the fixing device F decreases to the stop feasible temperature (S110). For example, the control portion 101 counts the number of rotations of the pair of conveying rollers 52*a* of the paper delivery conveying portion 52 every predetermined time interval, and integrates the continuous-paper conveying amount based on the counted number of rotations and the diameter of the pair of conveying rollers 52*a*, the pair of conveying rollers 52*a* configured to convey the continuous paper P.

For example, in a case where the temperature in the fixing device F is 170° C. and the stop feasible temperature is 100° C., it takes approximately five minutes to decrease a temperature of 170° C. in the fixing device F to a stop feasible temperature of 100° C. In this case, the control portion 101 conveys the continuous paper P in the paper conveying direction for approximately five minutes and integrates the amount of the continuous paper P conveyed during the five minutes.

Next, the control portion 101 receives the temperature in the fixing device F from a temperature detecting portion that detects the temperature in the fixing device F (not illustrated). Then, the control portion 101 determines whether the temperature in the fixing device F has decreased to the stop feasible temperature (S120). According to the present embodiment, the temperature detecting portion detects the temperature of the fixing belt 61 in proximity to the fixing nip as the temperature in the fixing device F.

As a result of the determination, in a case where the temperature in the fixing device F has decreased to the stop feasible temperature (Yes at S120), the control portion 101 stops conveying the continuous paper P in the paper conveying direction (S130). The control portion 101 stores the integrated conveying amount of the continuous paper P, as a conveying-amount integrated value, in the storage portion 70 (S140).

In a case where the temperature in the fixing device F has not decreased to the stop feasible temperature yet (No at S120), the processing goes back to S110. Then, the control portion 101 continues to convey the continuous paper P in the paper conveying direction and also continues to integrate the continuous-paper conveying amount from S110 last time.

With the temperature-decrease processing described above, the control portion 101 decreases the temperature in the fixing device F to the stop feasible temperature, conveying the continuous paper P in the paper conveying direction. The control portion 101 integrates the continuous-paper conveying amount that indicates the amount of the continuous paper P conveyed in the paper conveying direction, and stores the integrated continuous-paper conveying amount as the conveying-amount integrated value in the storage portion 70 during a period during which the temperature in the fixing device F decreases to the stop feasible temperature.

Next, the rewind processing in the image forming system 100 will be specifically described with reference to FIG. 4.

As described above, the rewind processing is the processing for conveying the continuous paper P conveyed in the paper conveying direction, to the direction opposite to the paper conveying direction in a section between the retaining portion 90 and the delivery 3 on the conveying path, and for retaining the continuous paper P in the retaining portion 90 during the temperature-decrease processing between the temperature-decrease processing and the warm-up processing. During the rewind processing, the control portion 101 performs processing for calculating an amount of the continuous paper P to be reversely conveyed (rewind amount). Then, the control portion 101 controls the delivery 3, the paper delivery conveying portion 52 of the paper conveying portion 50, the fixing portion 60, and the retaining portion 90. Thus, operation for conveying the continuous paper P in the calculated rewind amount in the direction opposite to the paper conveying direction and for retaining the continuous paper P in the retaining portion 90 (rewinding operation) is performed.

Figure 4:
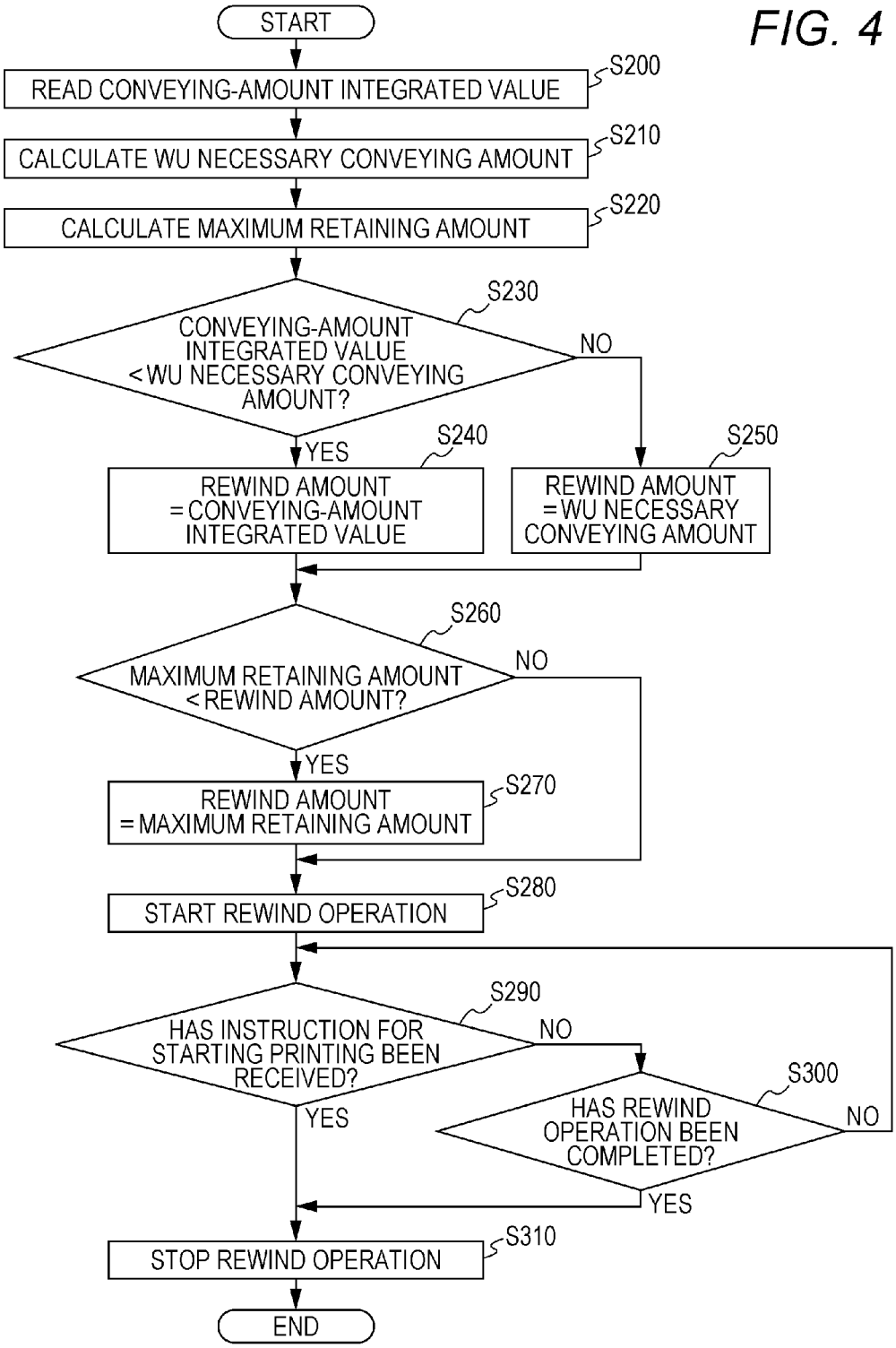
FIG. 4 is a flow chart of rewind processing according to the present embodiment.

In the rewind processing illustrated in FIG. 4, first, the control portion 101 reads the conveying-amount integrated value from the storage portion 70 (S200).

Next, the control portion 101 calculates a warm-up (WU) necessary conveying amount being a conveying amount of the continuous paper P necessary upon the WU for increasing the temperature in the fixing device F to the fixing temperature (S210).

Specifically, the control portion 101 calculates the WU necessary conveying amount based on the temperature in the fixing device F upon performance of the calculation (hereinafter, referred to as calculation-start fixing temperature), the fixing temperature, WU duration indicating time during which the WU continues, and WU conveying speed indicating the conveying speed upon performance of the WU. As setting information of the image forming system 100, the WU duration and the WU conveying speed are previously stored in the storage portion 70. According to the present embodiment, a method of calculating the WU necessary conveying amount depends on the calculation-start fixing temperature.

For example, in a case where the calculation-start fixing temperature is 60° C. or less, the WU necessary conveying amount is calculated by the following expression (1) with the WU duration and the WU conveying speed. For example, in a case where the WU duration is 360 sec and the WU conveying speed is 10 mm/sec, the WU necessary conveying amount to be calculated is 3600 mm.

$$\text{WU necessary conveying amount} = \text{WU duration} \times \text{WU conveying speed} \quad (1)$$

Meanwhile, in a case where the calculation-start fixing temperature exceeds 60° C., the WU necessary conveying amount is calculated by the following expression (2) with the fixing temperature, the calculation-start fixing temperature, temperature rising speed that indicates an increase ratio of the temperature in the fixing device F due to the heating of the heating roller 62, and the WU conveying speed. For example, in a case where the fixing temperature is 170° C., the calculation-start fixing temperature is 100° C., the temperature rising speed is 2.5° C./sec, and the conveying speed is 10 mm/sec, the WU necessary conveying amount to be calculated is 280 mm.

$$\text{WU necessary conveying amount} = (\text{fixing temperature} - \text{calculation-start fixing temperature})/\text{temperature rising speed} \times \text{conveying speed} \quad (2)$$

Next, the control portion 101 calculates a maximum retaining amount that indicates a maximum amount of the continuous paper P that can be retained in the retaining portion 90 (S220).

Here, the maximum retaining amount depends on, for example, the size of the hollow portion 91 of the retaining portion 90, the type of paper, the basis weight, and the rigidity of the continuous paper P. The maximum retaining amount is previously determined by, for example, experiment. The maximum retaining amount is distinguished by, for example, the type of paper, the basis weight, and the rigidity so as to be stored in the storage portion 70. The control portion 101 reads the maximum retaining amount from the storage portion 70 based on paper information, such as the type of paper, the basis weight, and the rigidity of the continuous paper P.

Next, the control portion 101 determines whether the conveying-amount integrated value is smaller than the WU necessary conveying amount (S230). As a result of the determination, in a case where the conveying-amount integrated value is smaller than the WU necessary conveying amount (Yes at S230), the control portion 101 sets the conveying-amount integrated value as the rewind amount (S240). After that, the processing proceeds to step S260. Meanwhile, in a case where the conveying-amount integrated value is the WU necessary conveying amount or more (No at S230), the control portion 101 sets the WU necessary conveying amount as the rewind amount (S250). After that, the processing proceeds to step S260.

At step S260, the control portion 101 determines whether the maximum retaining amount is smaller than the rewind amount set at S240 or at S250 (S260). As a result of the determination, in a case where the maximum retaining amount is smaller than the rewind amount (Yes at S260), the control portion 101 sets the maximum retaining amount as the rewind amount so as to update the rewind amount (S270). After that, the processing proceeds to step S280. Meanwhile, in a case where the maximum retaining amount is the rewind amount or more (No at S260), the control portion 101 does not update the rewind amount. Then, the processing proceeds to step S280.

As described above, the control portion 101 sets, as the rewind amount, the smallest conveying amount out of the conveying-amount integrated value, the WU necessary conveying amount, and the maximum retaining amount, by processing S230 to S270.

At step S280, the control portion 101 controls the delivery 3, the paper delivery conveying portion 52 of the paper conveying portion 50, the fixing portion 60, and the retaining portion 90. Thus, the operation for conveying the continuous paper P in the direction opposite to the paper conveying direction in the section between the retaining portion 90 and the delivery 3 on the conveying path and for retaining the continuous paper P in the retaining portion 90 (rewind operation), starts. Next, the control portion 101 determines whether an instruction for starting the next printing has been received (S290).

As a result of the determination, in a case where the instruction for starting the next printing has been received (Yes at S290), the processing proceeds to step S310. Meanwhile, in a case where the instruction for starting the next printing has not been received (No at S290), the control portion 101 determines whether the rewind operation has been completed (S300).

Specifically, the control portion 101 integrates a continuous-paper reversely conveying amount that indicates an amount of the continuous paper P conveyed in the direction opposite to the paper conveying direction. The control portion 101 determines whether the rewind operation has been completed based on whether the integrated continuous-paper reversely conveying amount has reached the set rewind amount.

As a result of the determination, in a case where the rewind operation has not been completed (No at S300), the control portion 101 determines whether the instruction for starting the next printing has been received at S290, continuing the rewind operation. Meanwhile, in a case where the rewind operation has been completed (Yes at S300), the processing proceeds to step S310.

At step S310, the control portion 101 stops the rewind operation. Upon the stop of the rewind operation, the control portion 101 stores the continuous-paper reversely conveying amount that indicates the amount of the continuous paper P conveyed in the direction opposite to the paper conveying direction during the rewind operation, in the storage portion 70. The stored continuous-paper reversely conveying amount indicates an amount of the continuous paper P retained in the retaining portion 90 at a point in time at which the rewind operation stops.

The control portion 101 retains the continuous paper P necessary upon the warm-up of the fixing portion 60, in the retaining portion 90, by the rewind processing described above.

Figure 5:
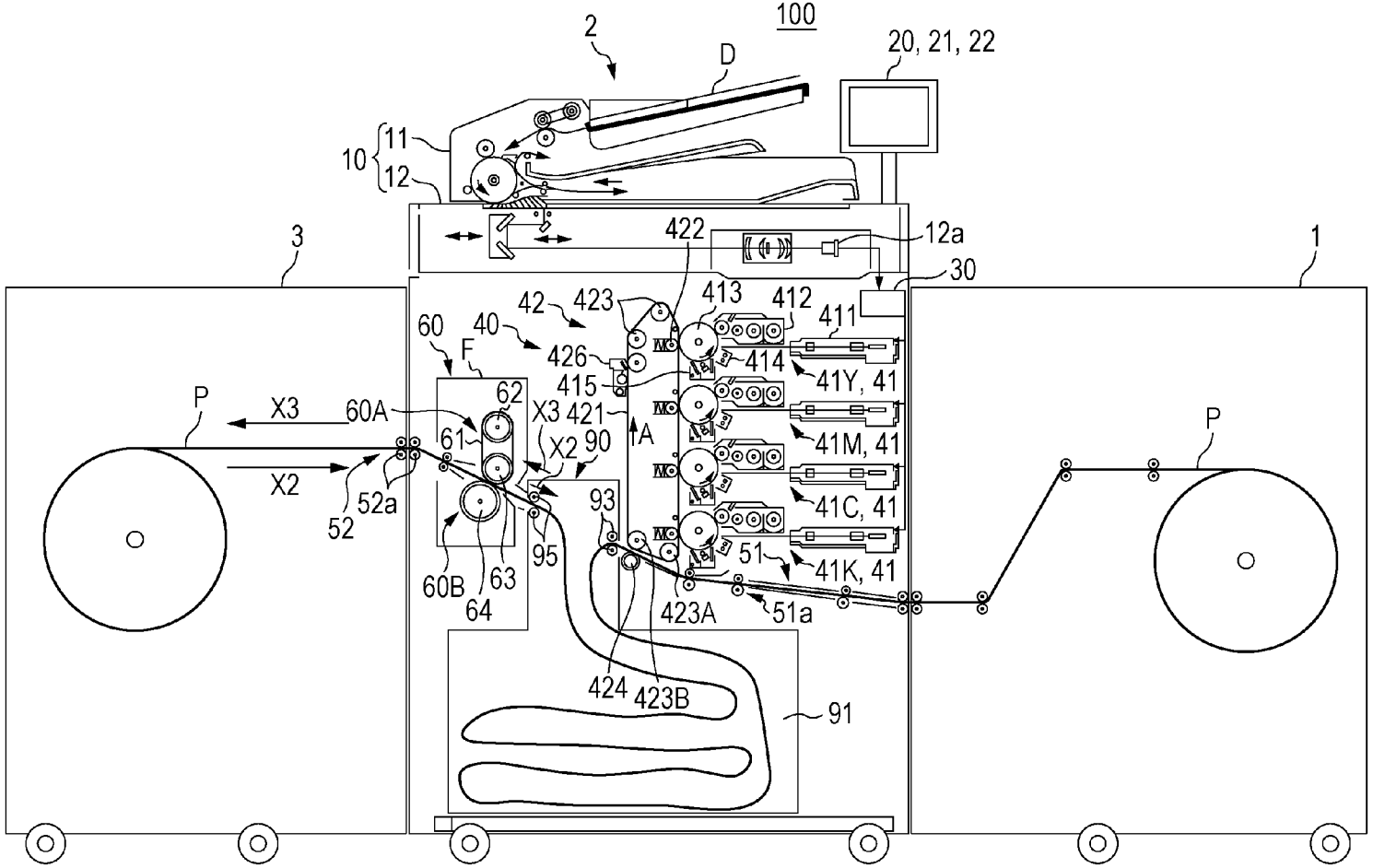
FIG. 5 is a schematic view of a state during the rewind processing of the image forming system.

FIG. 5 is a schematic view of a state during the rewind processing of the image forming system 100. In FIG. 5, configurations the same as those in FIG. 1 are denoted with the same reference numerals, and the descriptions thereof will be omitted.

The control portion 101 controls the delivery 3, the paper delivery conveying portion 52 of the paper conveying portion 50, the fixing portion 60, and the retaining portion 90. Thus, the rewind operation for conveying the continuous paper P in the direction opposite to the paper conveying direction (in a direction of arrow X2 in FIG. 5) in the section between the retaining portion 90 and the delivery 3 on the conveying path is performed.

During the rewind operation, the control portion 101 controls the retaining portion 90 so as to cause the pairs of conveying rollers 93 and 95 of the retaining portion 90 to clamp the continuous paper P. The control portion 101 rotates the pair of conveying rollers 95 so that the continuous paper P is conveyed in the direction opposite to the paper conveying direction. Simultaneously with the rotary operation of the pair of conveying rollers 95, the control portion 101 controls the conveying operation of the delivery 3, the paper delivery conveying portion 52, and the fixing portion 60 so that the continuous paper P is conveyed in the direction opposite to the paper conveying direction.

Meanwhile, the control portion 101 causes the pair of conveying rollers 93 not to rotate. This is because the transfer nip is prevented from being damaged due to conveyance of the continuous paper P to the upper stream side of the retaining portion 90 in the paper conveying direction.

As a result, part of the continuous paper P that has been rewound is retained so as to be accordion in the hollow portion 91 of the retaining portion 90 as illustrated in FIG. 5.

Next, the warm-up processing in the image forming system 100 will be specifically described.

In a case where an instruction for starting the printing has been received, the control portion 101 controls the fixing portion 60 so that the heating roller 62 heats, in order to increase the temperature in the fixing device F.

The control portion 101 controls the paper delivery conveying portion 52 of the paper conveying portion 50, the fixing portion 60, the delivery 3, and the retaining portion 90. Thus, conveying operation for conveying the continuous paper P retained in the retaining portion 90 in the paper conveying direction in the section between the retaining portion 90 and the delivery 3 on the conveying path, starts.

With descriptions with reference to FIG. 5, the control portion 101 performs the conveying operation for conveying the continuous paper P retained in the retaining portion 90 in the paper conveying direction in the section between the retaining portion 90 and the delivery 3 on the conveying path (arrow X3).

The control portion 101 integrates the continuous-paper conveying amount that indicates the amount of the continuous paper P conveyed in the paper conveying direction. The control portion 101 determines whether the continuous-paper conveying amount to be integrated has reached the continuous-paper reversely conveying amount to be read from the storage portion 70.

In a case where the continuous-paper conveying amount has reached the continuous-paper reversely conveying amount, namely, in a case where no continuous paper P retained in the retaining portion 90 is present, the retaining portion 90 becomes in a state similar to that in FIG. 1. In a case where the retaining portion 90 becomes in the state similar to that in FIG. 1 during the warm-up processing, the control portion 101 receives the temperature in the fixing device F from the temperature detecting portion, and determines whether the temperature in the fixing device F becomes the fixing temperature or more. As a result of the determination, in a case where the temperature in the fixing device F becomes the fixing temperature or more, the control portion 101 stops the conveying operation and starts printing operation.

Meanwhile, in a case where no continuous paper P retained in the retaining portion 90 is present and also the temperature in the fixing device F has not reached the fixing temperature, the control portion 101 controls the feeder 1, the image forming portion 40, the paper feed conveying portion 51 and the paper delivery conveying portion 52 of the paper conveying portion 50, the fixing portion 60, and the delivery 3 during a period during which the temperature in the fixing device F increases to the fixing temperature or more. Thus, conveying operation for conveying the continuous paper P in the paper conveying direction in a section between the feeder 1 and the delivery 3 on the conveying path (in a direction of arrow X1 in FIG. 1) is performed.

Then, in a case where the temperature in the fixing device F becomes the fixing temperature or more, the control portion 101 stops the conveying operation, and starts the printing operation.

As described in detail above, the image forming apparatus 2 according to the present embodiment, includes the paper conveying portion (conveying portion) 50, the image forming portion 40, the fixing portion 60, the retaining portion 90, and the control portion 101. The paper conveying portion 50 conveys the continuous paper P (continuous recording medium) in the paper conveying direction (first conveying direction) or in the direction opposite to the paper conveying direction (second conveying direction). The image forming portion 40 forms the toner images on the continuous paper P to be conveyed in the paper conveying direction by the paper conveying portion 50, at the transfer nip. The fixing portion 60 is provided on the lower stream side of the image forming portion 40 in the paper conveying direction. The fixing portion 60 heats and fixes the toner images formed on the continuous paper P by the image forming portion 40, at the fixing nip. The retaining portion 90 is provided between the transfer nip and fixing nip in the paper conveying direction, and retains the part of the continuous paper P. In a case where the formation of the toner images by the image forming portion 40 has been completed, after conveying the continuous paper P in the paper conveying direction in order to prevent the continuous paper P from being deformed due to the heating of the fixing portion 60, the control portion 101 controls the paper conveying portion 50 so that a passed portion that has passed through the fixing nip upon the conveyance, out of the continuous paper P, is conveyed in the direction opposite to the paper conveying direction. In addition, the control portion 101 controls the retaining portion 90 so that the passed portion is retained.

With this configuration, the continuous paper P conveyed in the small amount in the paper conveying direction during the period during which the temperature in the fixing device F decreases to a degree of temperature at which the continuous paper P is not damaged, is conveyed in the direction opposite to the paper conveying direction and then is retained between the fixing nip and the transfer nip. Thus, the problem caused by conveying the continuous paper P that has passed through the fixing nip, to the upper stream side of the transfer nip in the conveying direction, can be solved with a simple configuration.

With this configuration, a function capable of conveying the continuous paper P in the opposite direction is provided only to the fixing portion 60 and the paper conveying portion 50. There is no need to provide the function capable of conveying the continuous paper P in the opposite direction, for example, to the image forming portion 40 positioned on the upper stream side of the retaining portion 90 in the paper conveying direction. Therefore, the configuration of the apparatus can be simplified.

In the image forming apparatus 2 according to the present embodiment, the conveying amount of conveying the passed portion in the direction opposite to the paper conveying direction is set in a range in which the retaining portion 90 can retain the part of the continuous paper P.

With this configuration, an amount that cannot be retained in the retaining portion 90 is conveyed in the opposite direction. Thus, the continuous paper P retained in the retaining portion 90 can be inhibited from being damaged, such as a fold.

In the image forming apparatus 2 according to the present embodiment, the range in which the retaining portion 90 can retain the part of the continuous paper P, depends on the type of continuous paper P.

With this configuration, the amount that can be retained by the retaining portion 90 is determined in response to the basis weight, the type, and the rigidity of the continuous paper P. Thus, even in a case where the type of paper of the continuous paper P is varied, the retaining portion 90 can retain an appropriate amount.

In the image forming apparatus 2 according to the present embodiment, the conveying amount of conveying the passed portion in the direction opposite to the paper conveying direction is the WU necessary conveying amount of conveying the continuous paper P in the paper conveying direction in order to prevent the continuous paper P from being deformed due to the heating of the fixing portion 60 upon warm-up operation for increasing the fixing members of the fixing portion 60 in temperature before the continuous paper P is fed to the fixing nip. The WU necessary conveying amount is set based on the temperature of the fixing portion 60 at a point in time at which the conveyance of the passed portion in the direction opposite to the paper conveying direction starts.

With this configuration, the retaining portion 90 can retain the conveying amount necessary until the temperature in the fixing device F included in the fixing portion 60 increases to the fixing temperature.

Modification According to the Present Embodiment

Note that, according to the present embodiment, an example of a case where the retaining portion 90 retains the part of the continuous paper P in the hollow portion 91 disposed across the space below the image forming apparatus 2 from the space between the image forming portion 40 and the fixing portion 60 has been described. The present invention is not limited to this. A modification of the retaining portion according to the present embodiment includes a winding mechanism that winds the continuous paper P. The modification of a configuration of the retaining portion including the winding mechanism will be described below.

Figure 6B:
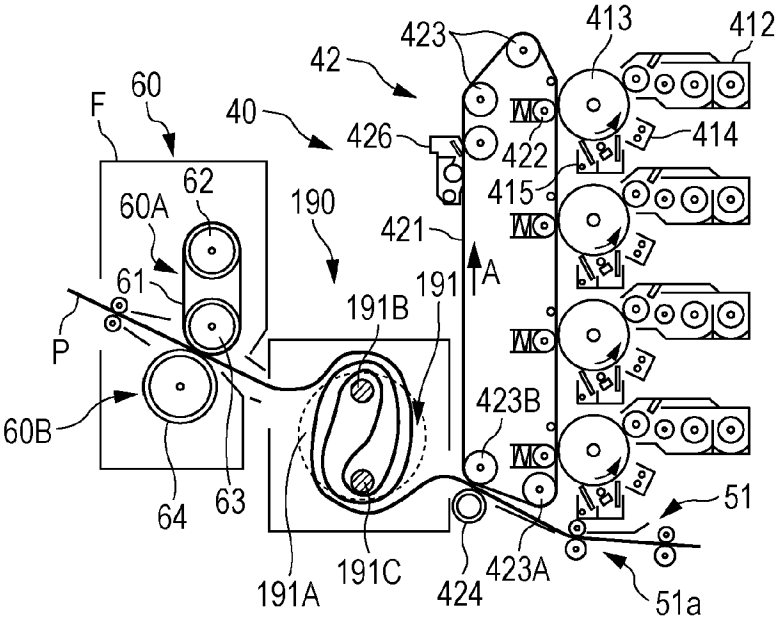
FIGS. 6A and 6B are views of a modification of a retaining portion according to the present embodiment.
Figure 6A:
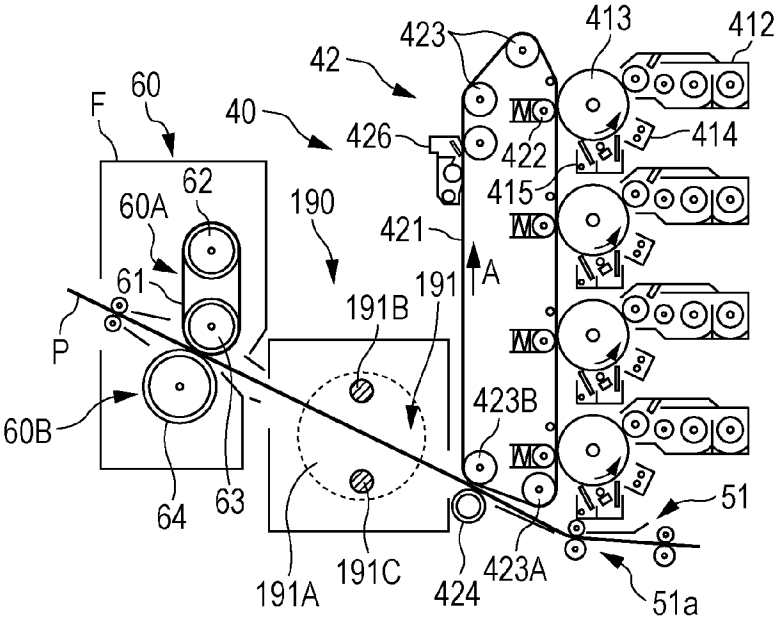

FIGS. 6A and 6B are views of the modification of the retaining portion 190 according to the present embodiment. FIG. 6A illustrates a state where the continuous paper P is not retained in the retaining portion 190. FIG. 6B illustrates a state where the continuous paper P is retained in the retaining portion 190. Note that, in FIGS. 6A and 6B, configurations the same as those in FIG. 1 are denoted with the same reference numerals, and the descriptions thereof will be omitted. In FIGS. 6A and 6B, only the retaining portion 190 and configurations around the retaining portion 190 are illustrated.

The retaining portion 190 in FIGS. 6A and 6B is provided between the image forming portion 40 and the fixing portion 60, and is configured to retain part of the continuous paper P, similarly to the retaining portion 90 in FIG. 1.

The retaining portion 190 includes the winding mechanism 191. The winding mechanism 191 includes a rotating plate 191A, a winding rod 191B, and a winding rod 191C.

The rotating plate 191A is disposed at a position in no contact with the continuous paper P on the side of one end of the continuous paper P in a width direction. The rotating plate 191A has a circular shape, and rotates around a rotary shaft, as the center, parallel to the width direction. Rotary operation of the rotating plate 191A is controlled by the control portion 101.

Each of the winding rods 191B and 191C is a rod-shaped member including one end coupled to the rotating plate 191A. The winding rod 191B is provided parallel to the width direction of the continuous paper P on the side of a front surface of the continuous paper P. The winding rod 191C extends parallel to the width direction of the continuous paper P on the side of a back surface of the continuous paper P. Each of the winding rods 191B and 191C is rotated around an axis thereof as the center, by the control of the control portion 101.

The control portion 101 controls the delivery 3, the paper delivery conveying portion 52, and fixing portion 60. Thus, the continuous paper P is conveyed in the direction opposite to the paper conveying direction in a section between the retaining portion 190 and the delivery 3 on the conveying path. Then, the control portion 101 rotates the rotating plate 191A. Thus, the winding rods 191B and 191C circle around the rotary shaft of the rotating plate 191A, exchanging positions thereof each other. The control portion 101 counterclockwise rotates the winding rod 191B, and clockwise rotates the winding rod 191C.

The control portion 101 mutually rotates the winding rods 191B and 191C in different directions, rotating the rotating plate 191A. Thus, as illustrated in FIG. 6B, operation for winding the continuous paper P to be conveyed in the direction opposite to the paper conveying direction, between the winding rod 191B and the winding rod 191C, is performed (rewind operation).

Figure 7:
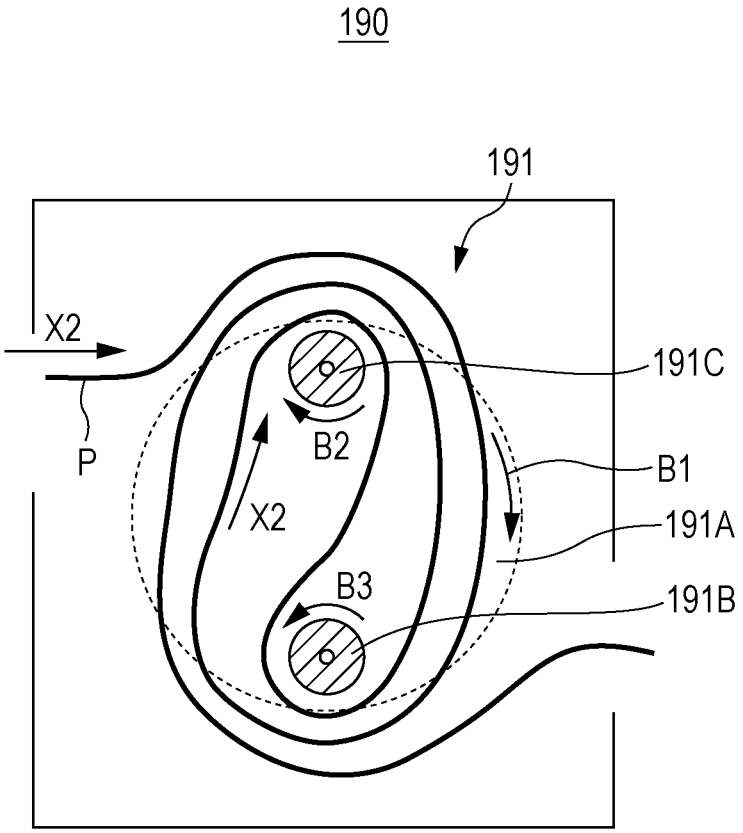
FIG. 7 is a view of rotary operation of the modification of the retaining portion according to the present embodiment.

Specifically, the rotary operation of the rotating plate 191A, the winding rods 191B and 191C in the retaining portion 190 illustrated in FIGS. 6A and 6B, will be described with reference to FIG. 7. In FIG. 7, configurations the same as those in FIGS. 6A and 6B are denoted with the same reference numerals, and the descriptions thereof will be omitted.

As illustrated in FIG. 7, when the control portion 101 clockwise rotates the rotating plate 191A (arrow B1), the winding rod 191C comes in contact with the continuous paper P on the lower stream side of the winding rod 191B in the paper conveying direction, namely, at a position closer to the fixing portion 60. In this case, the control portion 101 clockwise rotates the winding rod 191C (arrow B2), and counterclockwise rotates the winding rod 191B (arrow B3).

That is, when rotating the rotating plate 191A, the control portion 101 rotates the winding rod in contact with the continuous paper P at the position closer to the fixing portion 60, in a direction the same as that of the rotating plate 191A. The control portion 101 rotates the winding rod in contact with the continuous paper P at a position far away from the fixing portion 60, in a direction opposite to that of the rotating plate 191A.

In this manner, the control portion 101 clockwise rotates the winding rod 191C in a winding direction. Thus, the winding mechanism. 191 can wind the continuous paper P from the side of the fixing portion 60 in the direction opposite to the paper conveying direction (arrow X2). The control portion 101 counterclockwise rotates the winding rod 191B in a direction opposite to the winding direction being clockwise. Thus, the winding mechanism 191 is not required to wind the continuous paper P from the side of the image forming portion 40 including the transfer nip.

Note that, for example, a pair of rollers that clamps and fixes the continuous paper P is provided on the side of the image forming portion 40 of the winding mechanism 191 so as to fix the continuous paper P. Surfaces of the winding rods 191B and 191C are made so as to have small friction force with respect to the continuous paper P. Thus, the continuous paper P can be retained, similarly to the retaining portion 190 illustrated in FIG. 6B. In this case, a configuration in which each of the winding rods 191B and 191C rotates around the axis thereof as the center, is not necessary. Only the rotating plate 191A may rotate.

According to the modification of the present embodiment described above, the winding mechanism 191 includes the two winding rods (winding members) 191B and 191C mutually disposed on the side of the front surface (first surface) and the side of the back surface (second surface) of the continuous paper P, the two winding rods 191B and 191C extending parallel in the width direction of the continuous paper P. The two winding rods 191B and 191C rotate so as to be exchanged alternately between a position on the side of the front surface and a position on the side of the back surface. Thus, the continuous paper P is wound.

Note that, upon the performance of the rewind operation, the control portion 101 may control tension of the continuous paper P based on the paper information, such as the type of paper, the basis weight, and the rigidity of the continuous paper P, and the rewind amount.

For example, in a case where the continuous paper P is paper sturdy like thick paper and the rewind amount is a predetermined amount or more, the control portion 101 controls the rotational speed of the rotating plate 191A, and the rotational speeds of the winding rods 191B and 191C to be larger than the conveying speeds in the direction opposite to the paper conveying direction in the delivery 3, the paper delivery conveying portion 52, and the fixing portion 60. Thus, the tension of the continuous paper P is made to be strong. The control portion 101 makes the tension of the continuous paper P strong. Thus, in the retaining portion 190, a gap of the wound continuous paper P every circling is reduced and then a large amount of continuous paper P is wound in a narrower space.

Note that, as a configuration for making the tension of the continuous paper P strong, the tension of the continuous paper P upon the rewind may be made to be strong by adding a torque load to the paper delivery conveying portion 52 during the conveyance in the direction opposite to the paper conveying direction.

Meanwhile, even in a case where the continuous paper P is the paper sturdy like thick paper, and also in a case where the rewind amount is less than the predetermined amount, although the gap of the wound continuous paper P every circling increases, the continuous paper P in the rewind amount cannot be wound. Thus, the control portion 101 does not perform the control for making the tension of the continuous paper P strong. Since the tension of the continuous paper P is made so as not to be strong, the wound continuous paper P can be prevented from being deformed.

Figure 8A:
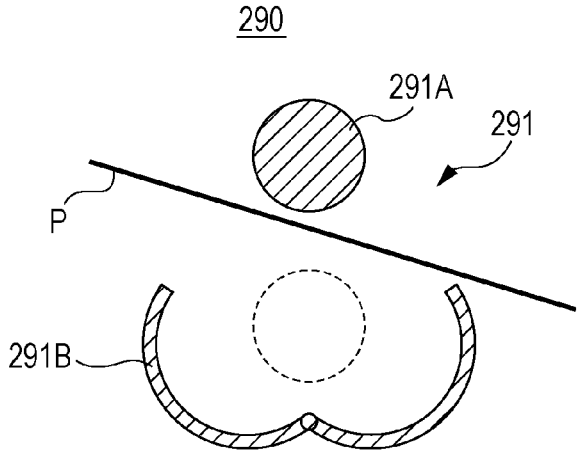
FIGS. 8A, 8B, and 8C are views of another modification of the retaining portion according to the present embodiment.
Figure 8B:
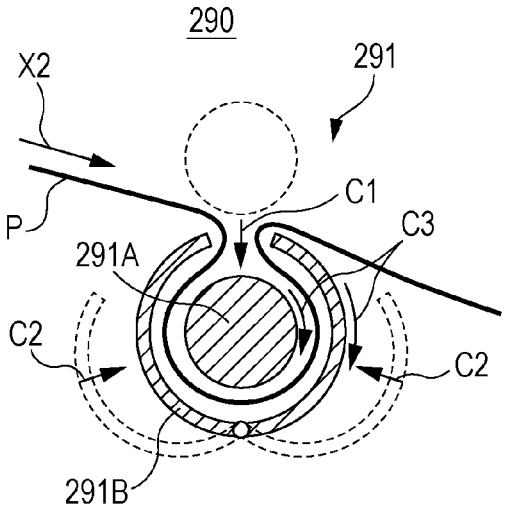
Figure 8C:
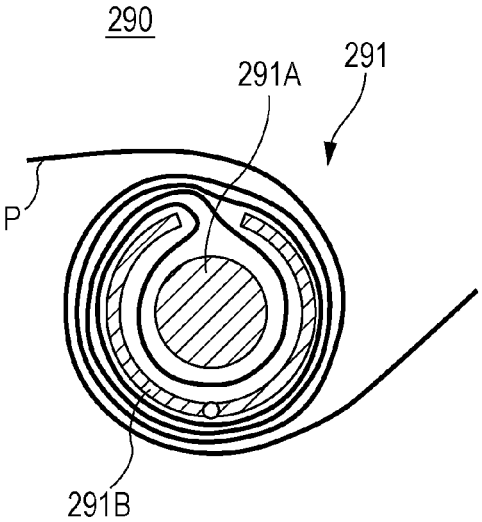

Next, another modification of the retaining portion according to the present embodiment will be described with reference to FIGS. 8A, 8B, and 8C. FIGS. 8A, 8B, and 8C are views of the modification of the retaining portion according to the present embodiment. FIG. 8A illustrates a state where a retaining portion 290 does not retain the continuous paper P. FIG. 8B illustrates a state where the retaining portion 290 starts to retain the continuous paper P. FIG. 8C illustrates a state where the retaining portion 290 retains the continuous paper P.

The retaining portion 290 in FIGS. 8A, 8B, and 8C includes a winding mechanism 291. The winding mechanism 291 includes a winding rod 291A and a clamp 291B.

The winding rod 291A is provided parallel to the width direction of the continuous paper P on the side of the front surface of the continuous paper P. The control portion 101 moves the winding rod 291A to the side of the clamp 291B, as illustrated with arrow C1 in FIG. 8B, upon a start of retaining operation in the retaining portion 290.

The clamp 291B is provided on the side of the back surface of the continuous paper P. The clamp 291B opens and closes so as to cover the winding rod 291A. After moving the winding rod 291A to the side of the clamp 291B, as illustrated with arrow C2 in FIG. 8B, the control portion 101 causes the clamp 291B to close so that the winding rod 291A is covered. Thus, the continuous paper P is clamped.

In a case where the winding rod 291A and the clamp 291B clamp the continuous paper P, as illustrated with arrow C3 in FIG. 8B, the control portion 101 rotates the winding rod 291A and the clamp 291B around an axis of the winding rod 291A as the center. Thus, the continuous paper P is wound in the direction opposite to the paper conveying direction (arrow X2 in FIG. 8B). As a result, as illustrated in FIG. 8C, the continuous paper P is wound around the outer circumference of the clamp 291B.

According to the modification of the present embodiment described above, the winding mechanism 291 includes the winding rod (winding member) 291A provided on the side of the front surface of the continuous paper P (first surface) and the clamp openable and closable (opening and closing member) 291B provided on the side of the back surface of the continuous paper P (second surface). After the winding rod 291A moves from the side of the front surface to the side of the clamp 291B, the clamp 291B closes so as to cover the winding rod 291A. Then, the continuous paper P is clamped. After that, the clamp 291B and the winding rod 291A rotate so that the clamp 291B winds the continuous paper P.

According to the modifications of the present embodiment described above, a larger number of recording media can be retained in a little space. Thus, the size of the retaining portion can be suppressed.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image forming apparatus comprising:

a conveying portion configured to convey a continuous recording medium in a first conveying direction or in a second conveying direction opposite to the first conveying direction;

an image forming portion configured to form a toner image on the continuous recording medium conveyed in the first conveying direction by the conveying portion, at a transfer portion;

a fixing portion provided on a lower stream side of the image forming portion in the first conveying direction, the fixing portion configured to heat and fix the toner image formed on the continuous recording medium by the image forming portion;

a retaining portion provided between the transfer portion and the fixing portion in the first conveying direction, the retaining portion configured to retain a part of the continuous recording medium; and a control portion configured to control the conveying portion such that:

the continuous recording medium is conveyed in the first conveying direction so that the toner image on the continuous recording medium passes through the fixing portion;

after the formation of the toner image by the image forming portion being completed and the toner image on the continuous recording medium being passed through the fixing portion, the continuous recording medium is further conveyed in the first conveying direction;

after the continuous recording medium being further conveyed in the first conveying direction, the continuous recording medium is conveyed in the second conveying direction to return a portion that has passed through the fixing portion, and a part of the continuous recording medium is retained in the retaining portion.

2. The image forming apparatus according to claim 1, wherein a conveying amount of conveying in the second conveying direction is set in a range in which the retaining portion retains the part of the continuous recording medium.

3. The image forming apparatus according to claim 2, wherein the range in which the retaining portion retains the part of the continuous recording medium, depends on a type of the continuous recording medium.

4. The image forming apparatus according to claim 1, wherein the conveying amount of conveying in the second conveying direction is a warm-up necessary conveying amount of conveying the continuous recording medium in the first conveying direction during warming-up of the fixing portion, and the warm-up necessary conveying amount is set based on a temperature of the fixing portion at a point in time at which the conveyance of the passed portion in the second conveying direction starts.

5. The image forming apparatus according to claim 1, wherein the retaining portion includes a winding mechanism that winds the part of the continuous recording medium.

6. The image forming apparatus according to claim 5, wherein the winding mechanism includes two winding members mutually provided on a side of a first surface and a side of a second surface of the continuous recording medium, the two winding members extending in a width direction of the continuous recording medium, and the winding mechanism winds the continuous recording medium by rotating the two winding members to be exchanged alternately between a position on the side of the first surface and a position on the side of the second surface.

7. The image forming apparatus according to claim 5, wherein the winding mechanism includes a winding member provided on the side of the first surface of the continuous recording medium, and an opening and closing member provided on the side of the second surface of the continuous recording medium, the opening and closing member configured to open and close, and the winding mechanism clamps the continuous recording medium by closing the opening and closing member to cover the winding member, and winds the continuous recording medium around the opening and closing member by rotating the opening and closing member and the winding member after the winding member moves from the side of the first surface to a side of the opening and closing member.

8. An image forming system comprising:

a feeder configured to feed a continuous recording medium to the image forming apparatus according to claim 1;

the image forming apparatus configured to form an image on the continuous recording medium fed by the feeder; and a delivery configured to house the continuous recording medium on which the image has been formed by the image forming apparatus.

* * * * *